US009052091B2

(12) United States Patent
Buck et al.

(10) Patent No.: US 9,052,091 B2
(45) Date of Patent: Jun. 9, 2015

(54) ALIGNMENT BASE FOR ELONGATED LIGHTING FIXTURE

(71) Applicant: Wahini Holdings, West Jordan, UT (US)

(72) Inventors: Drew A. Buck, West Jordan, UT (US); Michael Ray Wamsley, West Jordan, UT (US); Shawn R. Thomas, West Jordan, UT (US)

(73) Assignee: Wahine Holdings, L.L.C., West Jordan, UT (US)

( * ) Notice: Subject to any disclaimer, the term of this patent is extended or adjusted under 35 U.S.C. 154(b) by 125 days.

(21) Appl. No.: 13/851,920

(22) Filed: Mar. 27, 2013

(65) Prior Publication Data

US 2013/0258651 A1 Oct. 3, 2013

Related U.S. Application Data

(60) Provisional application No. 61/616,387, filed on Mar. 27, 2012.

(51) Int. Cl.

| | |
|---|---|
| ***F21V 21/00*** | (2006.01) |
| ***F21V 19/00*** | (2006.01) |
| ***F21V 21/06*** | (2006.01) |
| *F21V 27/02* | (2006.01) |
| *F21W 121/00* | (2006.01) |
| *F21W 131/109* | (2006.01) |
| *F21Y 101/02* | (2006.01) |

(52) U.S. Cl.

CPC ..... *F21V 19/0075* (2013.01); *F21V 27/02* (2013.01); *F21V 21/06* (2013.01); *F21W 2121/00* (2013.01); *F21W 2131/109* (2013.01); *F21Y 2101/02* (2013.01)

(58) Field of Classification Search

CPC ..... F21V 21/06; F21V 19/0075; F21V 27/02; F21V 19/008; F21W 2131/109; F21W 2121/00; F21W 2131/103; F21Y 2101/02

USPC ..... 362/217.6, 431; 59/295, 296; 175/45 R; 403/380; 248/423

See application file for complete search history.

(56) References Cited

U.S. PATENT DOCUMENTS

| | | | | |
|---|---|---|---|---|
| 2,846,570 | A * | 8/1958 | Harling | 362/396 |
| 4,194,237 | A * | 3/1980 | Conklin | 362/253 |
| 5,499,885 | A * | 3/1996 | Chapman | 403/380 |
| 5,921,663 | A * | 7/1999 | Flammer | 362/294 |
| 6,138,973 | A * | 10/2000 | Woodward | 248/423 |
| 8,555,603 | B1 * | 10/2013 | Perry | 52/848 |
| 2006/0241816 | A1 * | 10/2006 | Draaijer | 700/286 |
| 2013/0067713 | A1 * | 3/2013 | Myer | 29/426.1 |

FOREIGN PATENT DOCUMENTS

KR 100948039 B1 * 3/2010

OTHER PUBLICATIONS

Machine Translation to English of KR100948039B1 Mar. 2010.*

* cited by examiner

*Primary Examiner* — Anh Mai
*Assistant Examiner* — Glenn Zimmerman
(74) *Attorney, Agent, or Firm* — David N. Preece; TechLaw Ventures, PLLC

(57) ABSTRACT

A system and apparatus for vertically aligning predominately elongated lighting fixtures, and for providing a secure attachment to the ground through a foundation.

20 Claims, 10 Drawing Sheets

ALIGNMENT BASE FOR ELONGATED LIGHTING FIXTURE

CROSS-REFERENCE TO RELATED APPLICATIONS

This application claims priority to Provisional Application No. 61/616,387 entitled IMPROVED LOW VOLTAGE LIGHTING METHODS, APPARATUSES AND SYSTEMS, which was filed on Mar. 27, 2012 under 37 CFR 1.53(c).

BACKGROUND

The present disclosure relates generally to lighting, and more particularly, but not necessarily entirely, to landscape lighting. Within the landscape lighting industry it a common problem for installed, earthbound lighting fixtures to become misaligned causing reduced and undesired light casting and a poor appearance. With both small scale and large scale fixtures, may require alignment when installed or after periods of time after being installed. Current lighting products often require alignment at the foundation level, if a foundation is poured for the light fixture, or require re-staking for staked lighting products. For large scale lighting fixtures re-staking may be tantamount to reinstalling, thus being very costly and inefficient.

Additionally for large scale lighting fixtures, the industry has relied exclusively on high voltage for large fixture installations. High voltage use is highly regulated and oversized for many of the applications wherein it is being utilized. Regulation means specialized training is required for even the most simple of installations, and specialized training means additional costs.

The prior art is thus characterized by several disadvantages that are addressed by the present disclosure. The present disclosure minimizes, and in some aspects eliminates, the above-mentioned failures, and other problems, by utilizing the methods and structural features described herein.

The features and advantages of the present disclosure will be set forth in the description which follows, and in part will be apparent from the description, or may be learned by the practice of the present disclosure without undue experimentation.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
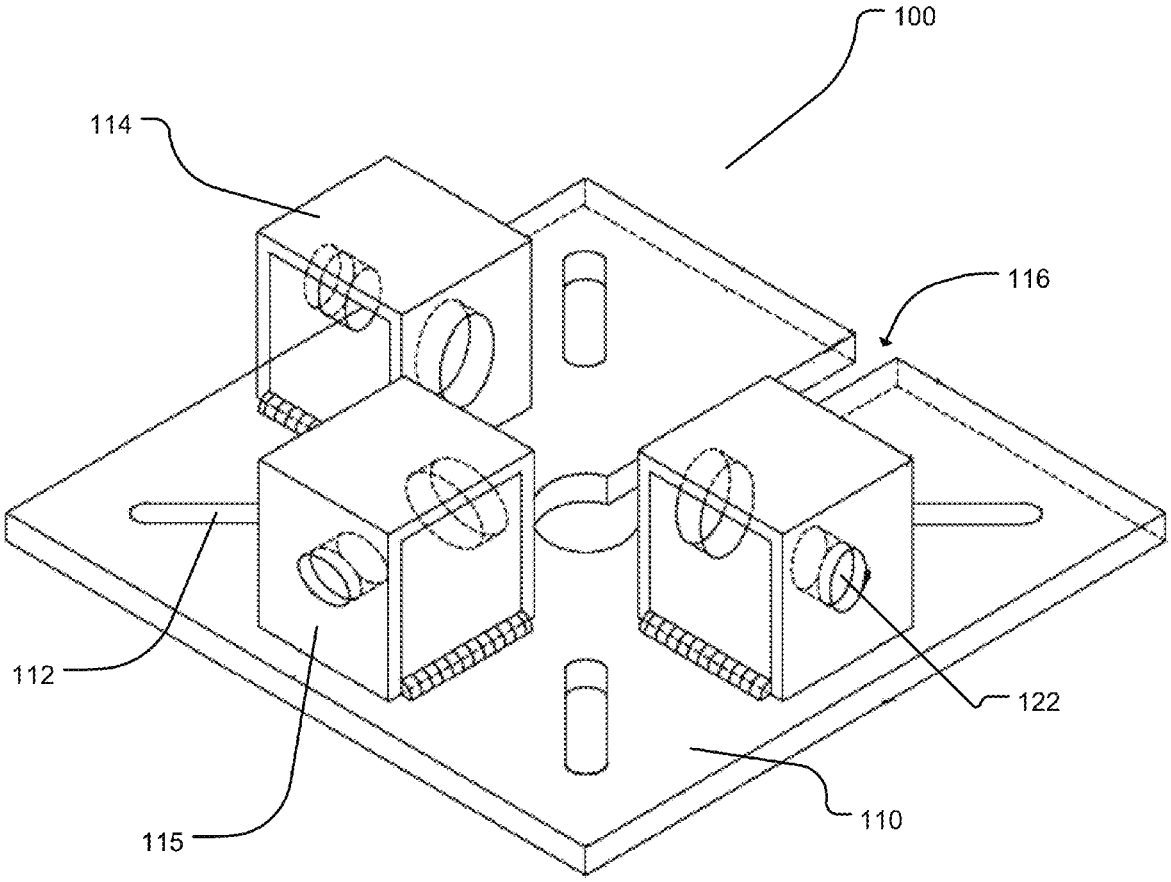
FIG. 1 illustrates an orthogonal view of an embodiment of an alignment base consistent with the principles and teachings of the disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed. It is also to be understood that the terminology employed herein is used for the purpose of describing particular embodiments only and is not intended to be limiting because the scope of the present disclosure will be limited only by the appended claims and equivalents thereof as allowed by the law.

The publications and other reference materials, if any, referred to herein to describe the background of the disclosure, and to provide additional detail regarding its practice, are hereby incorporated by reference herein in their entireties, with the following exception: In the event that any portion of said reference materials is inconsistent with this application, this application supersedes said reference materials.

The reference materials discussed herein are provided solely for their disclosure prior to the filing date of the present application. Nothing herein is to be construed as a suggestion or admission that the inventors are not entitled to antedate such disclosure by virtue of prior disclosure, or to distinguish the present disclosure from the subject matter disclosed in the reference materials.

It should be noted that, as used in this specification and the appended claims, the singular forms "a," "an," and "the" include plural referents unless the context clearly dictates otherwise. In describing and claiming the present disclosure, the following terminology will be used in accordance with the definitions set out below.

As used herein, the terms "comprising," "including," "containing," "characterized by," and grammatical equivalents thereof are inclusive or open-ended terms that do not exclude additional, unrecited elements or method steps.

As used herein, the phrase "consisting of" and any grammatical equivalents thereof exclude any element, step, or ingredient not specified in the claim.

As used herein, the phrase "consisting essentially of" and the grammatical equivalents thereof limit the scope of a claim to the specified materials or steps and those that do not materially affect the basic and novel characteristic or characteristics of the claimed disclosure.

As used herein, the term "proximal" shall refer broadly to the concept of a nearest portion. For example, the cap is the proximal-most portion of the fixture, because it is the highest portion when said fixture is installed.

As used herein, the term "distal" shall generally refer to the opposite of proximal, and thus to the concept of a further portion, or a furthest portion, depending upon the context.

As used herein, the phrase "in an at least partially proximal-to-distal direction" shall refer generally to a two-dimensional concept of direction in which the "proximal-to-distal" direction defines one direction or dimension. An item that extends in a non-parallel direction with respect to the "proximal-to-distal" direction, that is, at a non-straight angle thereto, thereby involves two components of direction, one of which is in the "proximal-to-distal" direction and the other being in a direction orthogonal to the "proximal-to-distal" direction. For example, the alignment base extends in a proximal-to-distal direction.

Referring now to FIG. 1 an embodiment of an alignment base made from various components will be discussed. While other embodiments may be made primarily of a single piece body, another embodiment maybe made from more commonly available components and then assembled into a standing structure. FIG. 1 illustrates an orthogonal view of an embodiment of an alignment base 100 consistent with the principles and teachings of the disclosure. As can be seen in the figure, the alignment base 100 may comprise a base plate 110 having a plurality of anchoring slots 112 for use in attaching the base to the cement foundation (shown in FIG. 2). The anchoring slots may provide an opening that passes completely through the base plate 110 thickness such that a fastener may be inserted therethrough, thereby attaching the alignment base 110 to a foundation.

An embodiment of the alignment base 100 may further comprise a plurality of attachment structures 114 for receiving a tubular body of a light fixture to the base plate 110. The attachment structures 114 may be made from sections of square tubing or common angle steel for ease of manufacture. As illustrated in the figure, the attachment structures 114 may be attached to the base plate 110 through any suitable manner, such as for example, welding, bonding, fastening with fasteners. In an embodiment, the alignment base 100 may comprise a base plate 110 and attachment structures 114 that are formed in a unitary manner from a single material. As shown in the figure, the attachment structures 114 comprise a friction surface 115 that is configured to mechanically interact with, and abut against, the inner surface of a tubular body of an elongated fixture. Examples of attachment structures may comprise L-brackets, blocks, tubing, rods, and the like.

In an embodiment wherein the attachment structures 114 may be configured to correspond to the inner tubular body cross sectional shape of the fixture. For example if the tubular body cross section is square having flat inner surfaces the friction surfaces 115 of the attachment structures 114 may be flat so as to correspond with the flat inner surfaces 115 of the tubular body. Additionally, if the tubular body cross section is round having curved inner surfaces the friction surfaces 115 of the attachment structures 114 may be curved so as to correspond with the flat inner surfaces 115 of the tubular body.

In an embodiment the attachment structures 114 may further comprise a fastener opening 122 for receiving a fastener therein for fastening a body of a fixture to the alignment base 110. In an embodiment the fastener opening 122 may be threaded to receive a threaded fastener therein. Fasteners to be considered to fall within the scope of the disclosure are those fasteners that are currently available or that are yet to be discovered that may correspond with the fastening structures of the disclosure without significant modification. Commonly know fasteners may include such things as bolts, nuts, screws, studs, rods, pins, and the like.

Figure 8:
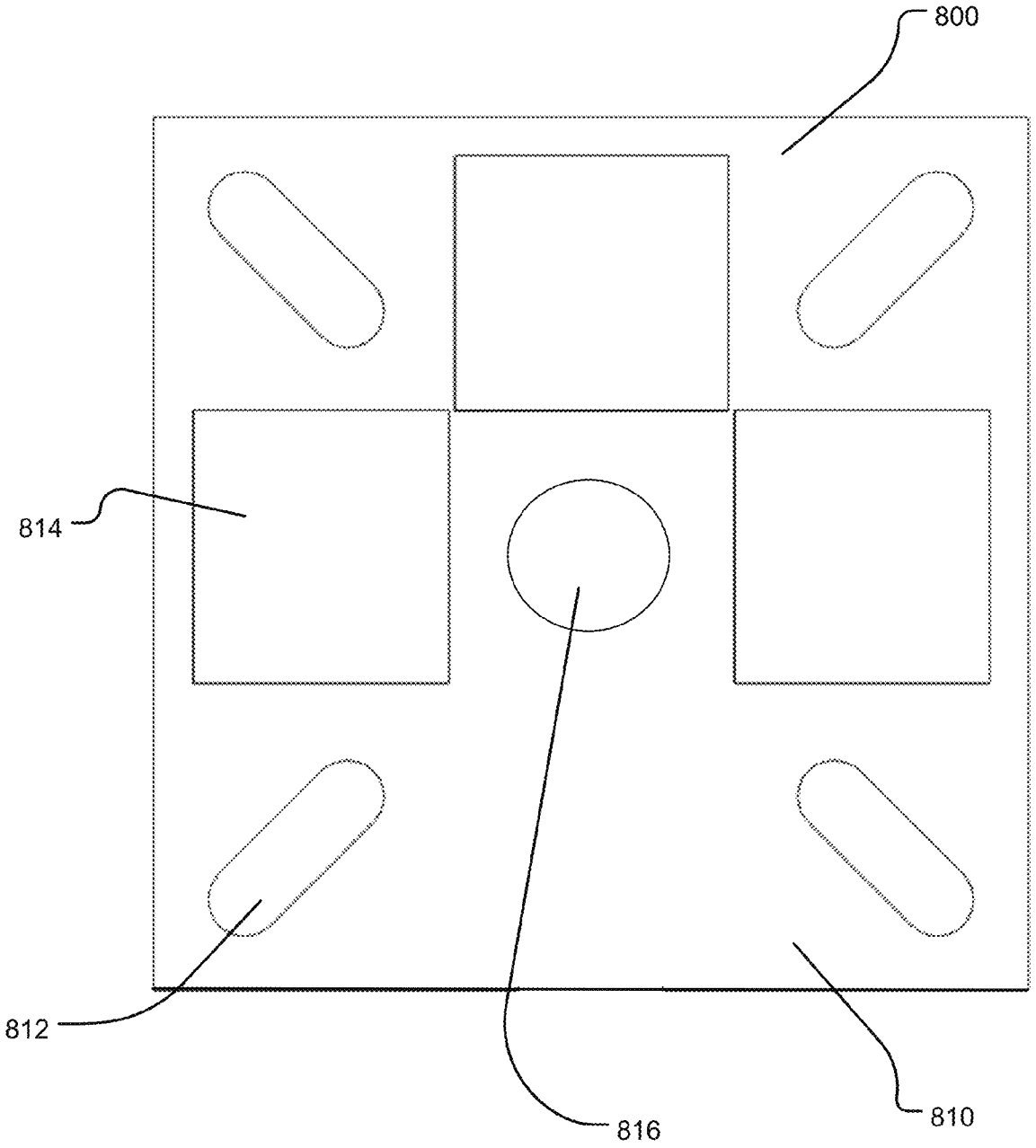
FIG. 8 illustrates a top view of an embodiment of an alignment structure consistent with the principles and teachings of the disclosure.

An embodiment of the alignment base may further comprise a wiring slot 116 to accommodate electrical wiring therein for powering a light element within the lighting fixture. The wiring slot 116 may be a wire channel in the base plate 110 is formed by a slot cut in the base plate from the center of the base plate to an edge of the base plate as illustrated in FIG. 1, or may be an opening 816 or hole in the base plate as illustrated in FIG. 8.

Figure 2:
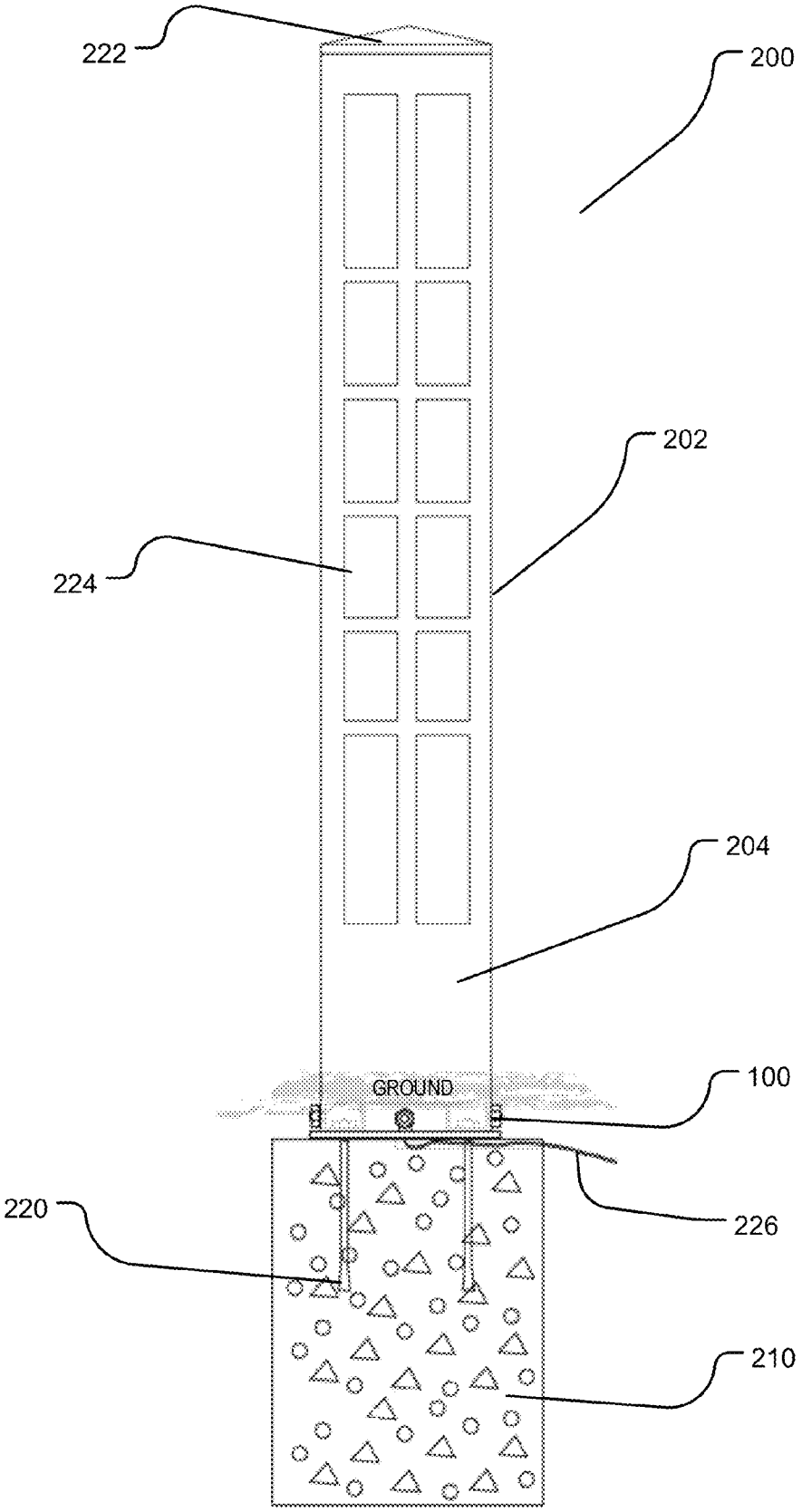
FIG. 2 illustrates an embodiment of an elongated lighting system having an alignment base consistent with the principles and teachings of the disclosure.

FIG. 2 illustrates an embodiment of an elongated lighting system 200 having an alignment base 100 joining an elongated lighting fixture 202 to a foundation 210. As can be seen in the figure, wiring 226 may supply power to a light socket and light element within the light fixture 202. The wiring 226 may pass through the alignment base 100 through a wiring slot 116. In an embodiment, anchor bolts 220 may be used to secure the alignment base 100 to a foundation 210 that may be disposed within the ground.

Additionally, the light system 200 may comprise a tubular body for positioning a lighting element vertically off of the ground. In such an embodiment the attachment structures of the alignment base may be configured to correspond to the inner tubular body cross sectional shape of the fixture. For example if the tubular body cross section is square having flat inner surfaces the friction surfaces of the attachment structures may be flat so as to correspond with the flat inner surfaces of the tubular body. Additionally, if the tubular body cross section is round having curved inner surfaces the friction surfaces of the attachment structures may be curved so as to correspond with the flat inner surfaces of the tubular body. In an embodiment the bottom opening of the tubular body may comprise a plurality of alignment slots configured to mechanically interact with a fastener that corresponds to the plurality of attachment structures of the alignment base.

An embodiment of a lighting system may further comprise light windows 224 and a cap 222.

Figure 3:
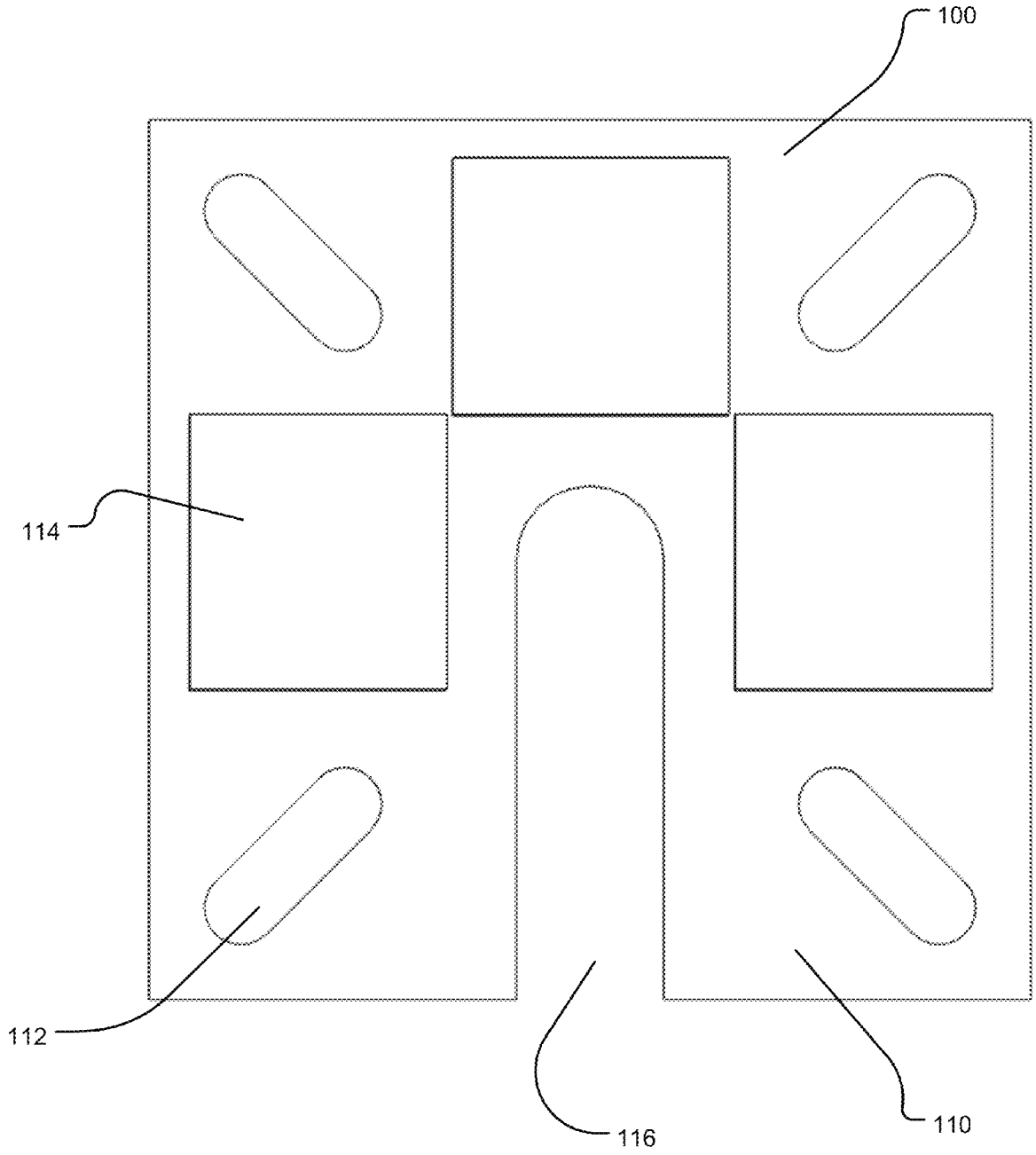
FIG. 3 illustrates a top view of an embodiment of an alignment base consistent with the principles and teachings of the disclosure.

FIG. 3 illustrates a top view of an embodiment of an alignment base consistent with the principles and teachings of the disclosure. As can be seen in the figure, the alignment base 100 may comprise a base plate 110 having a plurality of anchoring slots 112 for use in attaching the base to the cement foundation (shown in FIG. 2). The anchoring slots may provide an opening that passes completely through the base plate 110 thickness such that a fastener may be inserted therethrough, thereby attaching the alignment base 110 to a foundation. The anchoring slots 114 may be elongated openings that allow for variations in anchor placement in a foundation.

An embodiment of the alignment base 100 may further comprise a plurality of attachment structures 114 for receiving a tubular body of a light fixture to the base plate 110. The attachment structures 114 may be made from sections of square tubing or common angle steel for ease of manufacture. The attachment structures 114 may be attached to the base plate 110 through any suitable manner, such as for example, welding, bonding, fastening with fasteners. In an embodiment, the alignment base 100 may comprise a base plate 110 and attachment structures 114 that are molded in a unitary manner from a single material. As shown in the figure, the attachment structures 114 comprise a friction surface that is configured to mechanically interact with, and abut against, the inner surface of a tubular body of an elongated fixture. Examples of attachment structures may comprise L-brackets, blocks, tubing, rods, and the like.

In an embodiment wherein the attachment structures 114 may be configured to correspond to the inner tubular body cross sectional shape of the fixture and may comprise a wiring slot 116 to accommodate electrical wiring therein for powering a light element within the lighting fixture. The wiring slot 116 may be a wire channel in the base plate 110 is formed by a slot cut in the base plate from the center of the base plate to an edge of the base plate as illustrated in FIG. 3, or may be an opening 816 or hole in the base plate as illustrated in FIG. 8.

Figure 4:
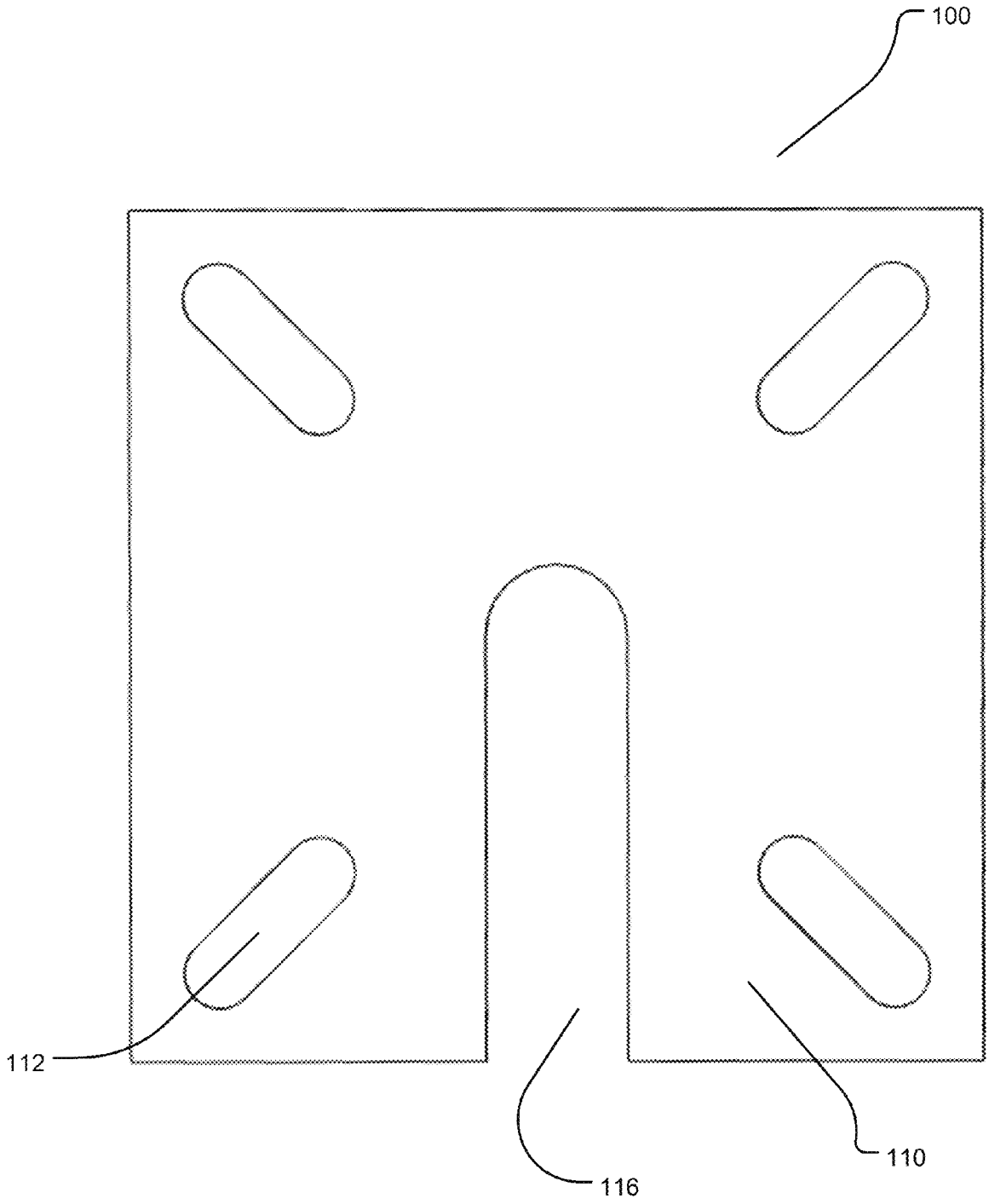
FIG. 4 illustrates a bottom view of an embodiment of an alignment base consistent with the principles and teachings of the disclosure.

FIG. 4 illustrates a bottom view of an embodiment of an alignment base consistent with the principles and teachings of the disclosure. As can be seen in the figure, the alignment base 100 may comprise a base plate 110 having a plurality of anchoring slots 112 for use in attaching the base to the cement foundation (shown in FIG. 2). The anchoring slots may provide an opening that passes completely through the base plate 110 thickness such that a fastener may be inserted therethrough, thereby attaching the alignment base 110 to a foundation. The anchoring slots 114 may be elongated openings that allow for variations in anchor placement in a foundation.

As shown, the embodiment may comprise a wiring slot 116 to accommodate electrical wiring therein for powering a light element within the lighting fixture. The wiring slot 116 may be a wire channel in the base plate 110 is formed by a slot cut in the base plate from the center of the base plate to an edge of the base plate as illustrated in FIG. 4, or may be an opening 816 or hole in the base plate as illustrated in FIG. 8.

Figure 5:
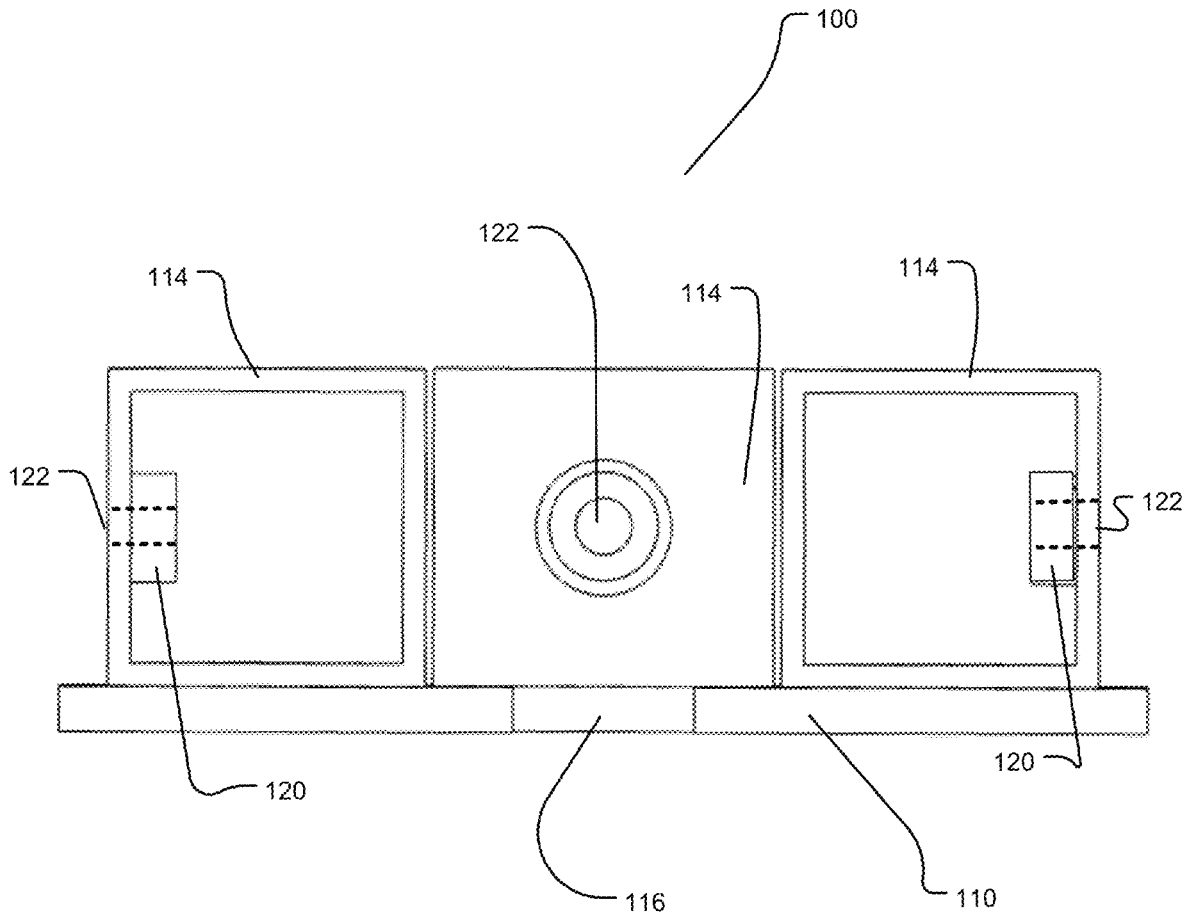
FIG. 5 illustrates a front view of an embodiment of an alignment base consistent with the principles and teachings of the disclosure.

FIG. 5 illustrates a front view of an embodiment of an alignment base consistent with the principles and teachings of the disclosure. As can be seen in the figure, the alignment base 100 may comprise a base plate 110 having a plurality of anchoring slots 112 for use in attaching the base to the cement foundation (shown in FIG. 2). The anchoring slots may provide an opening that passes completely through the base plate 110 thickness such that a fastener may be inserted therethrough, thereby attaching the alignment base 110 to a foundation.

An embodiment of the alignment base 100 may further comprise a plurality of attachment structures 114 for receiving a tubular body of a light fixture to the base plate 110. The attachment structures 114 may be made from sections of square tubing or common angle steel for ease of manufacture. As illustrated in the figure, the attachment structures 114 may be attached to the base plate 110 through any suitable manner, such as for example, welding, bonding, fastening with fasteners.

In an embodiment, the alignment base 100 may comprise a base plate 110 and attachment structures 114 that are formed in a unitary manner from a single material. As shown in the figure, the attachment structures 114 comprise a friction surface 115 that is configured to mechanically interact with, and abut against, the inner surface of a tubular body of an elongated fixture. Examples of attachment structures may comprise L-brackets, blocks, tubing, rods, and the like.

In an embodiment wherein the attachment structures 114 may be configured to correspond to the inner tubular body cross sectional shape of the fixture. For example if the tubular body cross section is square having flat inner surfaces the friction surfaces 115 of the attachment structures 114 may be flat so as to correspond with the flat inner surfaces 115 of the tubular body. Additionally, if the tubular body cross section is round having curved inner surfaces the friction surfaces 115 of the attachment structures 114 may be curved so as to correspond with the flat inner surfaces 115 of the tubular body.

In an embodiment the attachment structures 114 may further comprise a fastener opening 122 for receiving a fastener therein for fastening a body of a fixture to the alignment base 110. In an embodiment the fastener opening 122 may be threaded to receive a threaded fastener therein. Fasteners to be considered to fall within the scope of the disclosure are those fasteners that are currently available or that are yet to be discovered that may correspond with the fastening structures of the disclosure without significant modification. Commonly know fasteners may include such things as bolts, nuts, screws, studs, rods, pins, and the like. In an embodiment a press in threaded insert 120 may be used to add strength and threads for the use of threaded fasteners.

An embodiment of the alignment base may further comprise a wiring slot 116 to accommodate electrical wiring therein for powering a light element within the lighting fixture. The wiring slot 116 may be a wire channel in the base plate 110 is formed by a slot cut in the base plate from the center of the base plate to an edge of the base plate as illustrated in FIG. 5.

Figure 6:
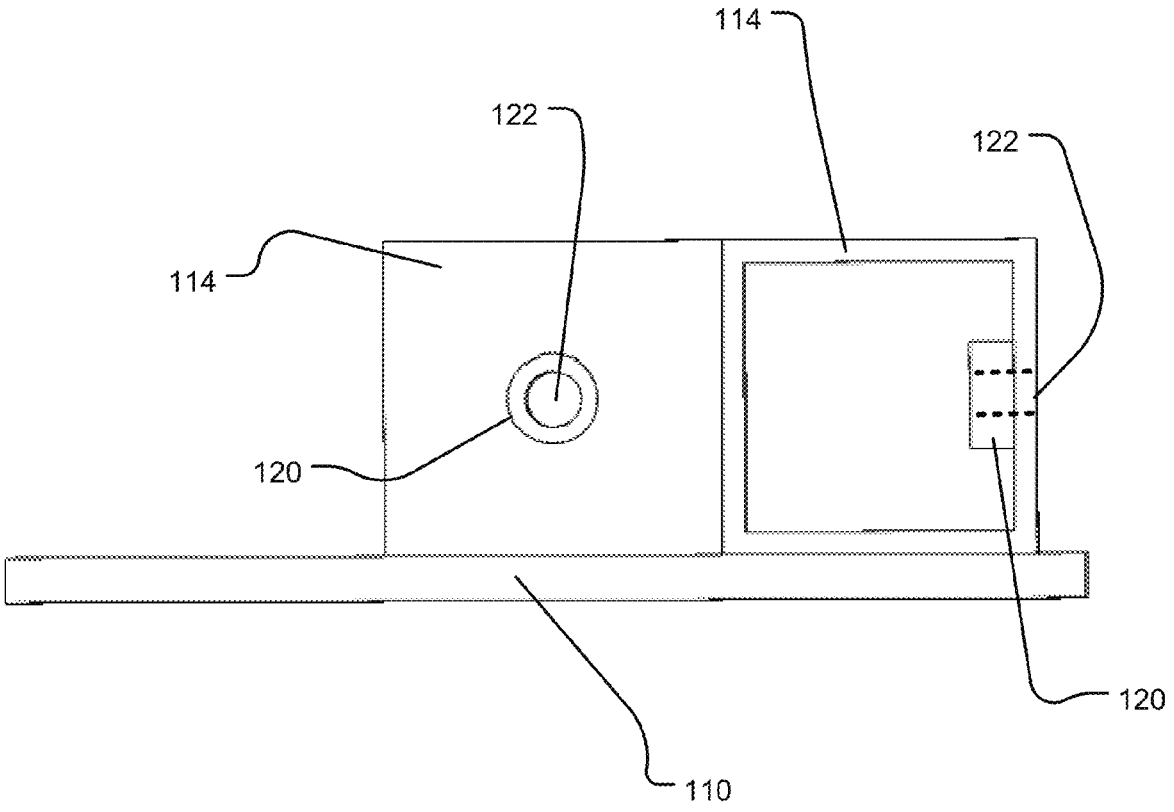
FIG. 6 illustrates a side view of an embodiment of an alignment base consistent with the principles and teachings of the disclosure.

FIG. 6 illustrates a side view of an embodiment of an alignment base consistent with the principles and teachings of the disclosure. As can be seen in the figure, the alignment base 100 may comprise a base plate 110 having a plurality of anchoring slots 112 for use in attaching the base to the cement foundation (shown in FIG. 2). The anchoring slots may provide an opening that passes completely through the base plate 110 thickness such that a fastener may be inserted therethrough, thereby attaching the alignment base 110 to a foundation.

An embodiment of the alignment base 100 may further comprise a plurality of attachment structures 114 for receiving a tubular body of a light fixture to the base plate 110. The attachment structures 114 may be made from sections of square tubing or common angle steel for ease of manufacture. As illustrated in the figure, the attachment structures 114 may be attached to the base plate 110 through any suitable manner, such as for example, welding, bonding, fastening with fasteners. In an embodiment, the alignment base 100 may comprise a base plate 110 and attachment structures 114 that are formed in a unitary manner from a single material. As shown in the figure, the attachment structures 114 comprise a friction surface 115 that is configured to mechanically interact with, and abut against, the inner surface of a tubular body of an elongated fixture. Examples of attachment structures may comprise L-brackets, blocks, tubing, rods, and the like.

In an embodiment wherein the attachment structures 114 may be configured to correspond to the inner tubular body cross sectional shape of the fixture. For example if the tubular body cross section is square having flat inner surfaces the friction surfaces 115 of the attachment structures 114 may be flat so as to correspond with the flat inner surfaces 115 of the tubular body. Additionally, if the tubular body cross section is round having curved inner surfaces the friction surfaces 115 of the attachment structures 114 may be curved so as to correspond with the flat inner surfaces 115 of the tubular body.

In an embodiment the attachment structures 114 may further comprise a fastener opening 122 for receiving a fastener therein for fastening a body of a fixture to the alignment base 110. In an embodiment the fastener opening 122 may be threaded to receive a threaded fastener therein. Fasteners to be considered to fall within the scope of the disclosure are those fasteners that are currently available or that are yet to be discovered that may correspond with the fastening structures of the disclosure without significant modification. Commonly know fasteners may include such things as bolts, nuts, screws, studs, rods, pins, and the like. In an embodiment a press in threaded insert 120 may be used to add strength and threads for the use of threaded fasteners.

Figure 7:
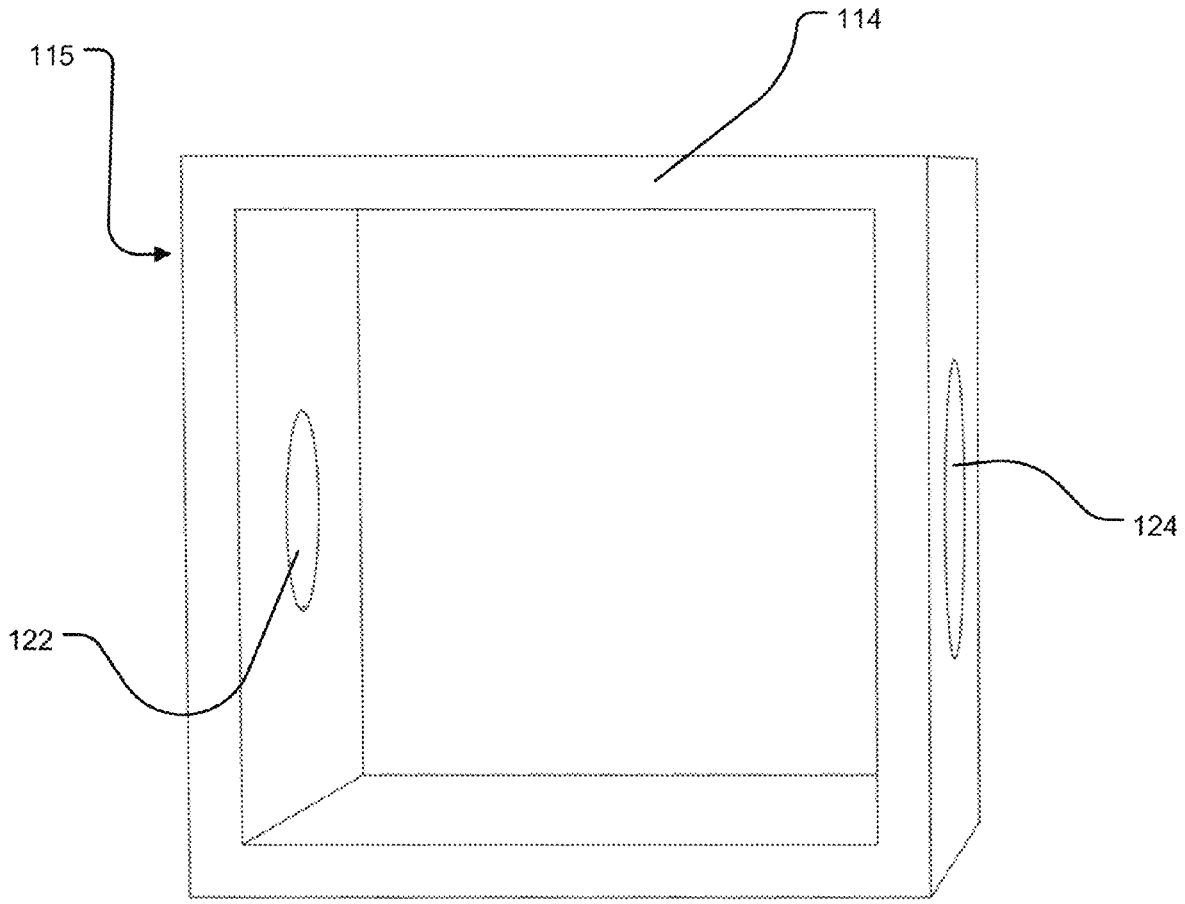
FIG. 7 illustrates a view of an embodiment of an alignment structure consistent with the principles and teachings of the disclosure.

FIG. 7 illustrates a view of an embodiment of an alignment structure consistent with the principles and teachings of the disclosure. The attachment structures 114 may be made from sections of square tubing or common angle steel for ease of manufacture. As illustrated in the figure, the attachment structures 114 may be attached to the base plate 110 through any suitable manner, such as for example, welding, bonding, fastening with fasteners. In an embodiment, the alignment base 100 may comprise a base plate 110 and attachment structures 114 that are formed in a unitary manner from a single material. As shown in the figure, the attachment structures 114 comprise a friction surface 115 that is configured to mechanically interact with, and abut against, the inner surface of a tubular body of an elongated fixture. Examples of attachment structures may comprise L-brackets, blocks, tubing, rods, and the like.

In an embodiment wherein the attachment structures 114 may be configured to correspond to the inner tubular body cross sectional shape of the fixture. For example if the tubular body cross section is square having flat inner surfaces the friction surfaces 115 of the attachment structures 114 may be flat so as to correspond with the flat inner surfaces 115 of the tubular body. Additionally, if the tubular body cross section is round having curved inner surfaces the friction surfaces 115 of the attachment structures 114 may be curved so as to correspond with the flat inner surfaces 115 of the tubular body.

In an embodiment the attachment structures 114 may further comprise a fastener opening 122 for receiving a fastener therein for fastening a body of a fixture to the alignment base 110. In an embodiment the fastener opening 122 may be threaded to receive a threaded fastener therein. Fasteners to be considered to fall within the scope of the disclosure are those fasteners that are currently available or that are yet to be discovered that may correspond with the fastening structures of the disclosure without significant modification. Commonly known fasteners may include such things as bolts, nuts, screws, studs, rods, pins, and the like. The attachment structure 114 may comprise an access opening 124 for manufacturing and aligning purposes.

FIG. 8 illustrates a top view of an embodiment of an alignment base consistent with the principles and teachings of the disclosure. As can be seen in the figure, the alignment base 800 may comprise a base plate 810 having a plurality of anchoring slots 812 for use in attaching the base to the cement foundation. The anchoring slots may provide an opening that passes completely through the base plate 810 thickness such that a fastener may be inserted therethrough, thereby attaching the alignment base 810 to a foundation. The anchoring slots 814 may be elongated openings that allow for variations in anchor placement in a foundation.

An embodiment of the alignment base 800 may further comprise a plurality of attachment structures 814 for receiving a tubular body of a light fixture to the base plate 810. The attachment structures 814 may be made from sections of square tubing or common angle steel for ease of manufacture. The attachment structures 814 may be attached to the base plate 810 through any suitable manner, such as for example, welding, bonding, fastening with fasteners. In an embodiment, the alignment base 800 may comprise a base plate 810 and attachment structures 814 that are molded in a unitary manner from a single material. As shown in the figure, the attachment structures 814 comprise a friction surface that is configured to mechanically interact with, and abut against, the inner surface of a tubular body of an elongated fixture. Examples of attachment structures may comprise L-brackets, blocks, tubing, rods, and the like.

In an embodiment wherein the attachment structures 814 may be configured to correspond to the inner tubular body cross sectional shape of the fixture and may comprise a wiring slot 816 to accommodate electrical wiring therein for powering a light element within the lighting fixture.

Figure 9:
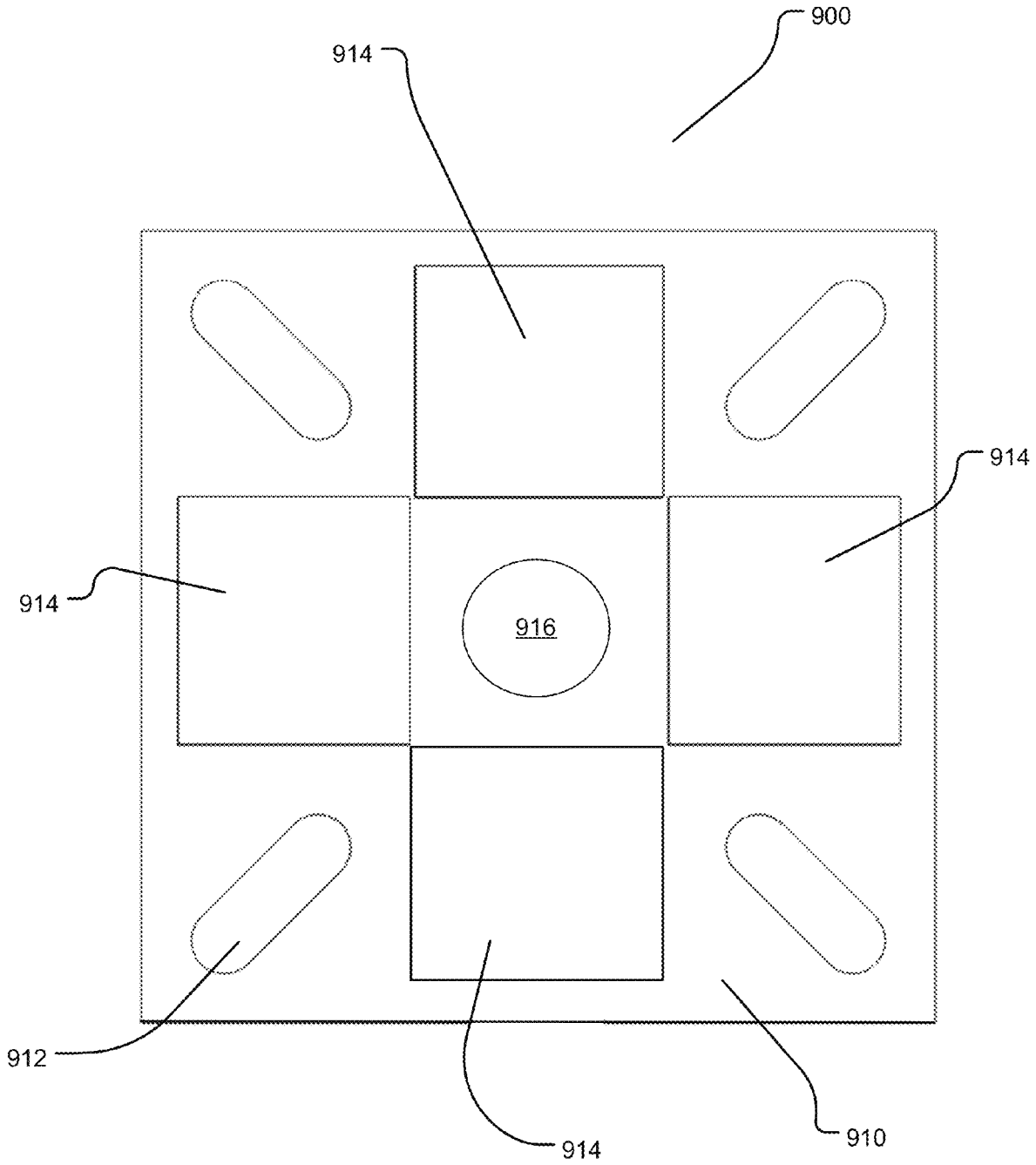
FIG. 9 illustrates a top view of an embodiment of an alignment base consistent with the principles and teachings of the disclosure.

FIG. 9 illustrates a top view of an embodiment of an alignment base consistent with the principles and teachings of the disclosure. As illustrated by the figure, an embodiment of an alignment base 900 may comprise four of anchoring openings 912 and four attachment structures 914.

Figure 10:
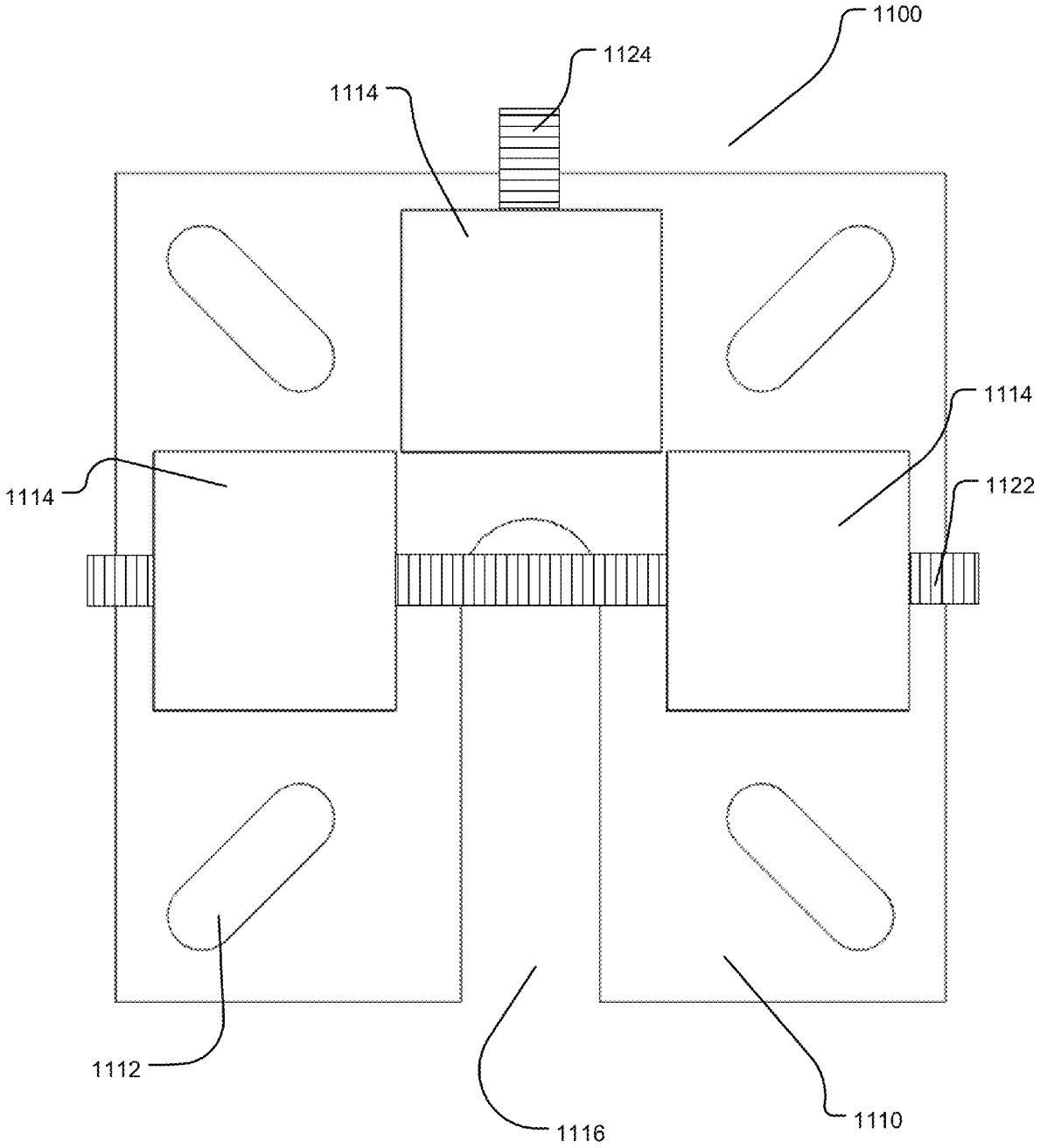
FIG. 10 illustrates a top view of an embodiment of an alignment base consistent with the principles and teachings of the disclosure.

FIG. 10 illustrates a top view of an embodiment of an alignment base consistent with the principles and teachings of the disclosure. As can be seen in the figure, attachment structures 1114 may be fitted with a threaded member that may be a threaded stud 1124 or a threaded rod 1122. The threaded members may then be used with a corresponding threaded fastener.

An embodiment may further include decorative panels that may also be attached to the standing structure.

An embodiment may comprise a manufactured metal frame that may be ⅛" or larger metal, distressed, tube or frame construction. This light can be out of a square, triangle, round or other single shape tube construction from 1" on up and can be cut to varying lengths. A small tube may be welded in an inside corner for a wire chase from the bottom to the top. An embodiment may also be made out of a framework of metal tubing for the corners and plates in between to create a more three dimensional light. Three of the corner tubes may comprise solid bars and the fourth side could be hollow to allow for a wire chase that would not be noticeable. The metal tube or frame construction could be made out of mild steel, copper, stainless steel, brass or aluminum.

An embodiment may comprise a mounting base plate that may be hidden, metal with bolt hardware. The base plate may be of solid metal construction. The alignment base may comprise a square plate, metal tubing for framework, thread and locking nuts, corners that may have holes for the 4⅜' concrete leveling anchors and a wire chase hole in the middle. The alignment base may be made out of mild steel, copper, stainless steel, brass or aluminum.

An embodiment may comprise a metal cap to protect the top of the fixture body and add to the overall artistic design. The metal cap may be made out of pot metal cast steel, mild steel, copper, stainless steel, brass or aluminum.

An embodiment may comprise a light socket that may be 240 volts to 12 volt and may accept varying types of halogen or LED bulbs. The socket may be adjustable to allow for better shielding of the light source.

An embodiment may comprise a light source or element that may be: a micro lantern or custom fixture distressed and custom finished to match other hardware. The fixture may have a halogen or LED light bulb light source. The light fixture may be mounted in or on the body.

An embodiment may comprise a base cover and mounting structure that provides easing mounting and aligning while providing an over built look.

Those having ordinary skill in the relevant art will appreciate the advantages provide by the features of the present disclosure.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim.

Rather, as the following claims reflect, inventive aspects lie in less than all features of a single foregoing disclosed embodiment. Thus, the following claims are hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A lighting system comprising:

a light element and lighting socket;

wherein the light element is disposed at the top portion of a vertical tubular body that is detachably attached to an alignment base that is anchored to a cement foundation;

wherein the alignment base comprises:

a base plate having a plurality of anchoring slots for use in attaching the base to the cement foundation;

a plurality of attachment structures for attaching the tubular body to the base plate;

wherein the attachment structures correspond to the tubular body cross sectional shape;

wherein each attachment structure comprises a friction surface that is configured to mechanically interact with an inner surface of the tubular body;

wherein the attachment structures further comprise a fastener opening for receiving a fastener therein;

the tubular body further comprising:

a top opening at the top portion;

a bottom opening having a plurality of vertical alignment slots configured for mechanically interacting with a fastener and a corresponding fastener opening of the attachment structures of the alignment base to provide vertical alignment of the tubular body; and a wire channel for allowing power supplying wire to the lighting fixture.

2. The system of claim 1, wherein the wire channel is disposed within the cement foundation.

3. The system of claim 1, wherein the wire channel is disposed within the base plate.

4. The system of claim 3, wherein the wire channel in the base plate is formed by a slot cut in the base plate from the center of the base plate to an edge of the base plate.

5. The system of claim 1, wherein the fastener openings are threaded.

6. The system of claim 5, wherein the fastener openings are created by press in threaded opening inserts.

7. The system of claim 1, wherein the alignment base comprises three attachment structures.

8. The system of claim 1, wherein the alignment base comprises four attachment structures.

9. The system of claim 1, further comprising a threaded rod disposed between opposing two opposing attachment structures.

10. The system of claim 1, further comprising a stud protruding from an attachment structure.

11. An alignment base for lighting fixtures comprising:

a base plate having a plurality of anchoring slots for use in attaching the base to the cement foundation;

a plurality of attachment structures for attaching a tubular body to the base plate;

wherein the attachment structures correspond to the tubular body cross sectional shape;

wherein each attachment structure comprises a friction surface that is configured to mechanically interact with an inner surface of the tubular body;

wherein the attachment structures further comprise a fastener opening for receiving a fastener therein;

wherein a plurality of fastener openings are may be positioned to correspond to a plurality of vertical alignment slots configured for mechanically interacting with a fastener to vertically align a tubular member attached thereto; and a wire channel for allowing power supplying wire to a lighting socket.

12. The alignment base of claim 11, wherein the wire channel is disposed in the base plate and a slot cut through the base plate from a center of the base plate to an edge of the base plate.

13. The alignment base of claim 11, wherein the fastener openings are threaded.

14. The alignment base of claim 13, wherein the fastener openings are created by press in threaded opening inserts.

15. The alignment base of claim 11, wherein the alignment base comprises three attachment structures.

16. The alignment base of claim 11, wherein the alignment base comprises four attachment structures.

17. The alignment base of claim 11, further comprising a threaded rod disposed between opposing two opposing attachment structures.

18. The alignment base of claim 11, further comprising a stud protruding from an attachment structure.

19. The alignment base of claim 11, wherein the attachment structures are rectangular tubular structures fastened to the base plate.

20. The alignment base of claim 11, wherein the anchoring slots are elongated for adjustability.

* * * * *